US009687042B2

(12) United States Patent
Berend et al.

(10) Patent No.: US 9,687,042 B2
(45) Date of Patent: Jun. 27, 2017

(54) ARTICLE OF FOOTWEAR WITH A MIDSOLE STRUCTURE

(71) Applicant: NIKE, Inc., Beaverton, OR (US)

(72) Inventors: Thomas Berend, Beaverton, OR (US); Christopher S. Cook, Portland, OR (US); Scott C. Holt, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 34 days.

(21) Appl. No.: 13/961,535

(22) Filed: Aug. 7, 2013

(65) Prior Publication Data

US 2015/0040432 A1 Feb. 12, 2015

(51) Int. Cl.
*A43B 13/18* (2006.01)
*A43B 7/14* (2006.01)
*A43B 13/20* (2006.01)

(52) U.S. Cl.
CPC ..... *A43B 7/144* (2013.01); *A43B 13/183* (2013.01); *A43B 13/20* (2013.01)

(58) Field of Classification Search
CPC ..... A13B 13/18; A13B 13/181
USPC ..... 36/27
See application file for complete search history.

(56) References Cited

U.S. PATENT DOCUMENTS 1,471,966 A 10/1923 Light
1,638,350 A * 8/1927 Long ..... 36/7.8
3,738,373 A * 6/1973 Glancy ..... 36/144
4,342,158 A 8/1982 McMahon et al.
4,638,575 A * 1/1987 Illustrato ..... 36/38
4,843,737 A 7/1989 Vorderer
4,881,329 A 11/1989 Crowley
4,910,884 A * 3/1990 Lindh et al. ..... 36/28
5,068,981 A 12/1991 Jung
D344,174 S 2/1994 Kilgore
5,343,639 A 9/1994 Kilgore et al.
5,353,523 A 10/1994 Kilgore et al.
5,367,790 A * 11/1994 Gamow et al. ..... 36/27
5,461,800 A * 10/1995 Luthi et al. ..... 36/28
5,517,769 A * 5/1996 Zhao ..... 36/27
5,577,334 A * 11/1996 Park ..... 36/28
5,643,148 A * 7/1997 Naville ..... 482/77
5,678,327 A * 10/1997 Halberstadt ..... 36/27
5,701,686 A * 12/1997 Herr et al. ..... 36/27
5,727,335 A * 3/1998 Kousaka et al. ..... 36/31
5,930,918 A * 8/1999 Healy et al. ..... 36/29
D422,131 S * 4/2000 Berend ..... D2/972
(Continued)

*Primary Examiner* — Clinton T Ostrup
*Assistant Examiner* — Anne Kozak
(74) *Attorney, Agent, or Firm* — Banner & Witcoff, Ltd.

(57) ABSTRACT

An article of footwear is disclosed that includes an upper and a midsole. A first midsole impact force attenuation structure or system is arranged at least within the toe region of the midsole. A second midsole impact force attenuation structure or system is arranged at least within the heel region of the midsole, such that the second midsole impact force attenuation structure or system includes a molded heel region member extending from a lateral side of the article of footwear to a medial side; the heel region member having a hollow central region defined by a first radius of curvature in a direction toward the toe region and a second radius of curvature in a direction toward the heel region. The first radius of curvature is different from the second radius of curvature. The heel region member may be in an asymmetrical stiffness construction.

16 Claims, 9 Drawing Sheets

(56) References Cited

U.S. PATENT DOCUMENTS

| | | | | |
|---|---|---|---|---|
| 6,318,001 | B1 * | 11/2001 | Lee | 36/27 |
| 6,436,012 | B1 * | 8/2002 | Naville | 482/77 |
| 6,447,429 | B1 * | 9/2002 | Chen et al. | 482/79 |
| 6,557,271 | B1 * | 5/2003 | Weaver, III | 36/27 |
| 6,694,642 | B2 * | 2/2004 | Turner | 36/28 |
| 6,745,499 | B2 | 6/2004 | Christensen et al. | |
| 6,763,612 | B2 | 7/2004 | Stubblefield et al. | |
| 6,860,034 | B2 * | 3/2005 | Schmid | 36/27 |
| 6,865,824 | B2 * | 3/2005 | Levert et al. | 36/29 |
| 6,925,732 | B1 * | 8/2005 | Clarke | 36/27 |
| 7,013,582 | B2 | 3/2006 | Lucas et al. | |
| 7,100,308 | B2 * | 9/2006 | Aveni | 36/27 |
| D534,346 | S * | 1/2007 | Dojan et al. | D2/977 |
| 7,181,866 | B2 | 2/2007 | Braunschweiler | |
| 7,350,320 | B2 * | 4/2008 | Chandler et al. | 36/28 |
| 7,458,172 | B2 * | 12/2008 | Aveni | 36/27 |
| 7,779,558 | B2 * | 8/2010 | Nishiwaki et al. | 36/27 |
| 7,877,898 | B2 * | 2/2011 | Aveni et al. | 36/28 |
| 7,950,166 | B1 * | 5/2011 | Perenich | 36/27 |
| 8,006,408 | B2 * | 8/2011 | Leedy et al. | 36/28 |
| 8,151,485 | B2 * | 4/2012 | Hurd et al. | 36/27 |
| 2003/0188455 | A1 * | 10/2003 | Weaver, III | 36/27 |
| 2004/0040183 | A1 * | 3/2004 | Kerrigan | 36/144 |
| 2004/0211088 | A1 * | 10/2004 | Volkart | 36/28 |
| 2004/0250446 | A1 * | 12/2004 | Greene et al. | 36/25 R |
| 2005/0005472 | A1 * | 1/2005 | Perenich | 36/27 |
| 2005/0268488 | A1 * | 12/2005 | Hann | 36/27 |
| 2007/0022628 | A1 | 2/2007 | Juan | |
| 2007/0119074 | A1 * | 5/2007 | Aveni et al. | 36/27 |
| 2007/0277395 | A1 * | 12/2007 | Aveni et al. | 36/27 |
| 2008/0016719 | A1 * | 1/2008 | Aveni et al. | 36/28 |
| 2008/0078101 | A1 * | 4/2008 | Smith et al. | 36/28 |
| 2008/0256827 | A1 * | 10/2008 | Hardy | A43B 13/181 36/27 |
| 2009/0100705 | A1 * | 4/2009 | Cook et al. | 36/29 |
| 2009/0126224 | A1 * | 5/2009 | Greene et al. | 36/27 |
| 2013/0118034 | A1 * | 5/2013 | Smaldone et al. | 36/102 |
| 2013/0199057 | A1 * | 8/2013 | Hurd et al. | 36/88 |
| 2013/0247422 | A1 * | 9/2013 | Holt et al. | 36/103 |
| 2014/0020264 | A1 * | 1/2014 | Holt | 36/103 |
| 2014/0068966 | A1 * | 3/2014 | Chaffin | 36/28 |
| 2014/0223771 | A1 * | 8/2014 | Berend et al. | 36/83 |
| 2014/0310982 | A1 * | 10/2014 | Delattre et al. | 36/28 |

* cited by examiner

ARTICLE OF FOOTWEAR WITH A MIDSOLE STRUCTURE

FIELD

The present invention relates to the field of footwear. The invention concerns, more particularly, an article of footwear having an upper and a sole structure for flexibility.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground.

BRIEF SUMMARY

The present invention pertains to an article of footwear with a sole structure.

In one aspect, an article of footwear includes an upper and a sole structure secured to the upper, and the sole structure includes an outsole and a midsole connected to the outsole and disposed between the outsole and the upper. The midsole further includes a heel region and a toe region. A first midsole impact force attenuating structure or system is arranged within the toe region of the midsole. A second midsole impact force attenuating structure or system is arranged within the heel region of the midsole, such that the second midsole impact force attenuating structure or system includes a molded heel region member extending from a lateral side of the article of footwear to a medial side; the heel region member having a hollow central region defined by a first radius of curvature in a direction toward the toe region and a second radius of curvature in a direction toward the heel region. The first radius of curvature is different from the second radius of curvature. In one aspect, the second radius of curvature is larger than first the radius of curvature.

In another aspect, the heel region member has a generally elliptical construction. In another aspect, the heel region member is formed of a plastic material. In yet another aspect, the heel region member is formed of Nylon. In one aspect, the heel region member is asymmetrical based on stiffness. In yet another aspect, the heel region member includes a medial portion and a lateral portion divided by a separation region. In one aspect, the medial portion and the lateral portion have a different stiffness. In another aspect, the medial portion and the lateral portion include a polymer matrix layer. In one aspect, the medial side and the lateral side of the heel region member include upwardly extending flanges. In another aspect, the heel region member includes a concave portion therein for retaining a heel of a wearer.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

The following discussion and accompanying figures describe articles of footwear having various constructions and structures.

Footwear 100 is depicted in the figures and discussed below as having a configuration that is suitable for athletic activities, particularly running. The concepts disclosed with respect to footwear 100, however, may be applied to footwear styles that are specifically designed for a wide range of other athletic activities, including basketball, baseball, football, soccer, walking, and hiking, for example, and these concepts may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Footwear 100 is depicted in FIGS. 1-12 and includes an upper 200 and a sole structure 300. Upper 200 may be formed from various material elements that are stitched or adhesively-bonded together to form an interior void that comfortably receives a foot and secures the position of the foot relative to sole structure 300. The void has the general shape of the foot, and access to the void is provided by an ankle opening. Accordingly, the upper 200 extends over the instep and toe areas of the foot, along the medial and lateral sides of the foot, and around the heel area of the foot. A lacing system or other securing means is often incorporated into the upper 200 to selectively change the size of the ankle opening and permit the wearer to modify certain dimensions of the upper 200, particularly girth, to accommodate feet with varying proportions. In addition, the upper 200 may include a tongue that extends under the lacing or other securing system to enhance the comfort of the footwear, and the upper 200 may include a heel counter to limit movement of the heel. Various materials may be utilized in manufacturing the upper 200.

Figure 1:
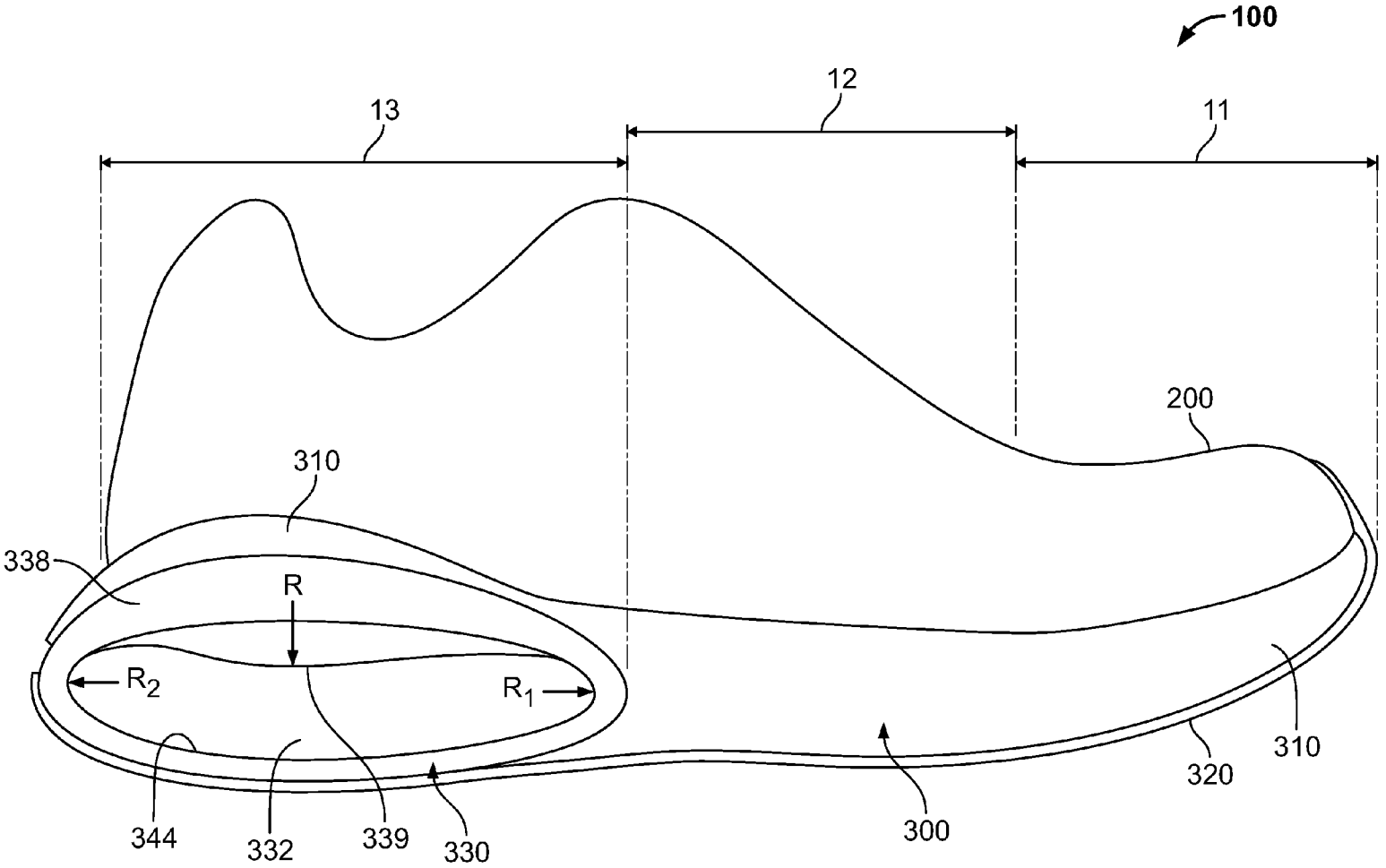
FIG. 1 is a lateral elevational view of an article of footwear according to one example of this invention.
Figure 2:
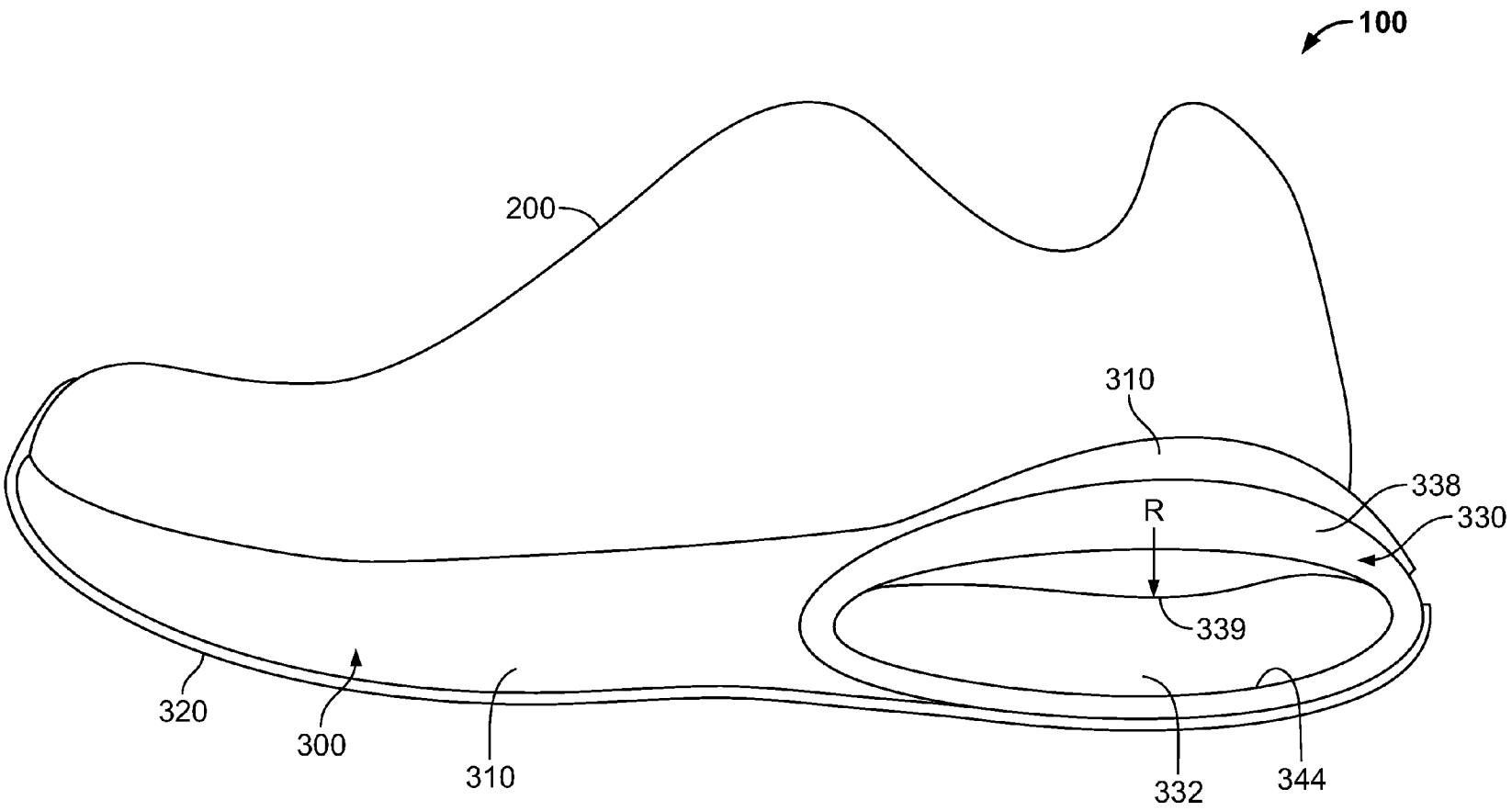
FIG. 2 is a medial elevational view of the article of footwear shown in FIG. 1.

For purposes of reference as shown in FIG. 1, footwear 100 may be divided into three general regions: a forefoot region 11, a midfoot region 12, and a rearfoot region 13. One of ordinary skill in the art should recognize that each region generally lies beneath the respective forefoot, midfoot, and rearfoot of a wearer when footwear 100 is properly sized. Regions 11-13 are not intended to demarcate precise areas of footwear 100. Rather, regions 11-13 are intended to represent general areas of footwear 100 that provide a frame of reference during the following discussion. Although regions 11-13 apply generally to footwear 100, references to regions 11-13 may also apply specifically to upper 200, sole structure 300, and/or other footwear components.

The upper 200 of an article of athletic footwear, for example, may be formed from multiple material layers that include an exterior layer, a middle layer, and an interior layer. The materials forming the exterior layer of the upper 200 may be selected based upon the properties of wear-resistance, flexibility, and air-permeability, for example. With regard to the exterior layer, the toe area and the heel area may be formed of leather, synthetic leather, or a rubber material to impart a relatively high degree of wear-resistance. Leather, synthetic leather, and rubber materials may not exhibit the desired degree of flexibility and air-permeability, at least not for all areas of the upper 200. Accordingly, various other areas of the exterior layer of the upper 200 may be formed from a synthetic textile. The exterior layer of the upper 200 may be formed, therefore, from numerous material elements that each impart different properties to specific areas of the upper 200.

A middle layer of the upper 200 may be formed from a lightweight polymer foam material that provides a soft feel and protects the foot from objects that may contact the upper 200. Similarly, an interior layer of the upper 200 may be formed of a moisture-wicking textile that removes perspiration from the area immediately surrounding the foot. In some articles of athletic footwear 100, the various layers may be joined with an adhesive, and stitching may be utilized to join elements within a single layer or to reinforce specific areas of the upper 200. Various areas of an upper 200 need not include all of these layers, if desired.

Sole structure 300 is secured to a lower portion of upper 200 and provides a durable, wear-resistant component for attenuating ground reaction forces and absorbing energy as footwear 100 impacts the ground. The sole structure 300 generally incorporates multiple layers that are conventionally referred to as an insole, a midsole, and an outsole. The insole (not shown) is a thin, relatively soft member located within the upper 200 and adjacent the plantar (lower) surface of the foot to enhance footwear comfort. The midsole 310, which is traditionally attached to the upper 200 along the entire length of the upper 200, forms the middle layer of the sole structure 300 and serves a variety of purposes that include controlling foot motions and providing impact force attenuation. The outsole 320 forms the ground-contacting element of footwear and is usually fashioned from a durable, wear-resistant material (e.g., rubber, thermoplastic polyurethanes, etc.) that includes texturing to improve traction.

Upper 200 and sole structure 300 have a structure that cooperatively articulate, flex, stretch, or otherwise move to provide an individual with improved forward propulsion. That is, upper 200 and sole structure 300 are configured to complement the natural motion of the foot during running or other activities.

A variety of materials are suitable for upper 200, including the materials that are conventionally utilized in footwear uppers. Accordingly, upper 200 may be formed from combinations of leather, synthetic leather, natural or synthetic textiles, polymer sheets, polymer foams, mesh textiles, knitted textiles, felts, non-woven polymers, or rubber materials, for example. In one arrangement, the exposed portions of upper 200 may be formed from two coextensive layers of material that are stitched or adhesively bonded together. Based upon the above discussion, the various portions of upper 200 include different combinations of materials. In further embodiments, however, different materials may be utilized for the various areas of the upper 200, or upper 200 may include more than two layers of material. In joining upper 200 and sole structure 300, adhesives, stitching, or a combination of adhesives and stitching may be utilized. In this manner, upper 200 is secured to sole structure 300 through a substantially conventional process.

As noted above, sole structure 300 includes a midsole structure 310 and an outsole 320. One primary element of midsole structure 310 is a resilient, polymer foam material, such as polyurethane or ethylvinylacetate, that is provided at least in a forefoot region, but also may extend throughout the length of the footwear 100. The properties of the polymer foam material in the midsole 310 are primarily dependent upon factors that include the dimensional configuration of the midsole 310 and the specific characteristics of the material selected for the polymer foam, including the density of the polymer foam material. By varying these factors throughout the midsole 310, the relative stiffness, degree of ground reaction force attenuation, and energy absorption properties may be altered to meet the specific demands of the activity for which the footwear 100 is designed and intended to be used.

Outsole 320 may include a plurality of outsole traction elements that are formed and/or engaged with the lower surface of the outsole 320. Outsole 320 provides at least a portion of an exterior bottom surface of the footwear 100 to provide wear-resistance and ground-engagement. Suitable materials for outsole 320 include any of the conventional rubber materials that are utilized in footwear outsoles, such as carbon black rubber compound.

The midsole structure 310 further includes a heel insert 330. The flexible structure of midsole 310 is configured to complement the natural motion of the foot during running or other activities. Midsole 310 attenuates ground reaction forces and absorbs energy to protect the foot and decrease the overall stress upon the foot. Suitable materials for midsole 310 are any of the conventional polymer foams that are utilized in footwear midsoles, including ethylvinylacetate and polyurethane foam.

The heel insert 330 may be formed with an elliptical shape or a flatten elliptical shape (e.g., raindrop shaped structure in which a rear curvature $R_2$ is greater than the front most curvature $R_1$) with an internal void/cavity 332 therein to provide for a region for flexing so that the structure 330 attenuates the ground impact forces on foot strikes. The ratio of the $R_2/R_1$ may be greater than 1.0. Heel insert 330 is formed to be resiliently flexible primarily along a longitudinal direction to provide a forward springing action. Additionally, the heel insert 330 is resiliently flexible along a transverse direction (medial-lateral direction) to provide side to side springing action. In this configuration, the midsole structure 310 with heel insert 330 enhances the comfort, motion-control qualities, stability, and/or ground or other contact surface reaction force attenuation properties of footwear 100. The heel insert 330 may be of a molded one-piece construction. Heel insert 330 may be made from any material exhibiting sufficient resilience and/or resistance to material. Suitable materials for heel insert 330 may include NYLON, polyether block amide (PEBA), carbon fiber reinforced polymers, other composite materials, or other combinations of materials.

In one construction, heel insert 330 can be formed by injection molding a plastic resin into a desired shape. If desired, the resin may be filled approximately 10% to 25% fiber material to form a plastic resin composite throughout the volume of insert 330. The plastic resin composite may be an enhanced resin having a filled fibrous composition, such as nylon, glass, or graphite fiber. The resin may be polyester. In one arrangement, the fibers can be oriented in a heel-to-toe direction or medial-to-lateral direction. In another arrangement, the fibers may be a chopped type mixed in the resin.

Figure 3:
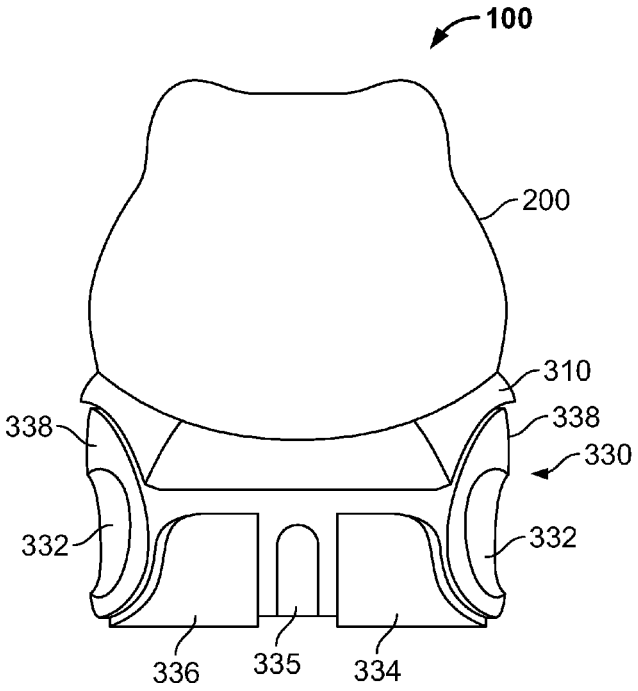
FIG. 3 is rear view of the article of footwear construction.
Figure 4:
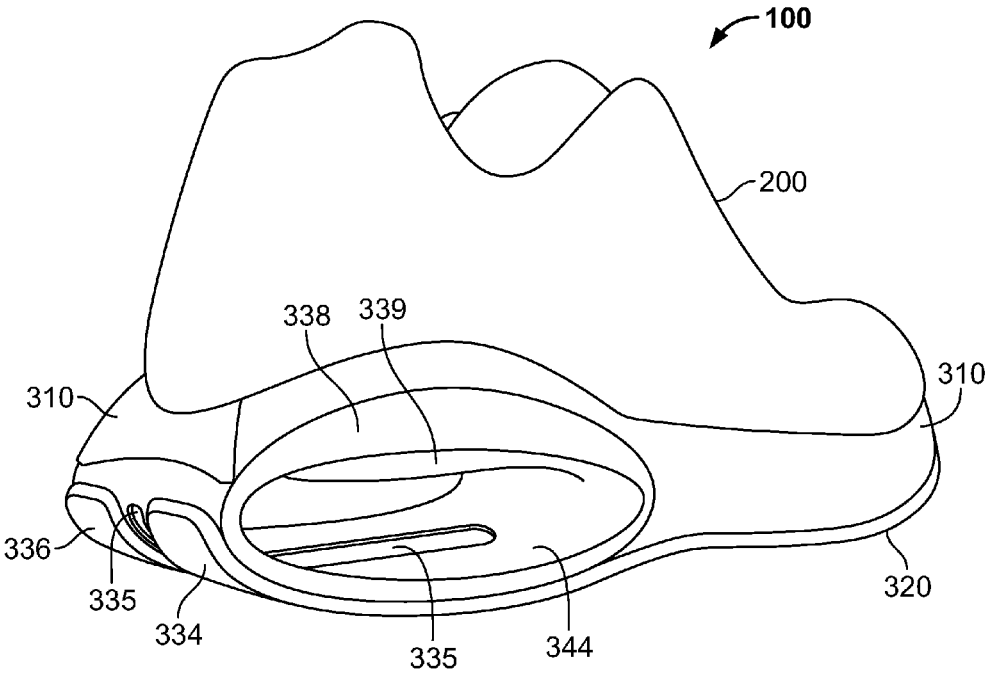
FIG. 4 is a perspective view of the article of footwear construction in FIG. 3.

In one construction, footwear 100 advantageously enhances traction control and stability of a foot of a wearer. As best shown in FIG. 3, heel insert 330 may have a lateral-medial enhancing performance in which heel insert 330 is made up of two regions: a lateral region 334 and a medial region 336, each region functions differently from each other based on the material construction. Nevertheless, the two regions 334 and 336 may have the same properties to function similarly. As shown in FIGS. 3 and 4, the heel insert 330 includes a lateral-medial dividing cutout 335 (e.g., separation region) in the lower portion 344, which is defined as a region generally formed by bisecting the front and rear of the heel insert 330 separating the two side-by-side regions of the sole 300. The cutout 335 in the thickness of heel insert 330 is not seen in side views of FIGS. 1 and 2. For ease of explanation, when footwear 100 is worn, lateral region 334 is generally oriented on the side facing away from of the centerline of a wearer's body, and medial region 336 is generally oriented on the side facing towards the centerline of the body.

In general, the motion of the foot during running proceeds as follows: initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last. The heel insert 330 may have a different stiffness of the lateral region 334 or medial region 336. The differences in stiffness can be accomplished by a combination of material molded in the heel insert 330. If desired, the stiffness can be provided by varying the thickness of heel insert 330 on the medial region 336 as compared to the lateral region 334. In one construction, the medial region 336 may have a larger thickness than lateral region 334.

The cutout 335 helps enhance flexibility of the heel insert 330 (and thus the overall sole member 300) along a front-to-rear direction of the shoe 100. More specifically, the cutout 335 better allows the lateral side of the heel insert 330 to flex somewhat more independent of the medial side of the heel insert 330 upon ground contact of the heel during a footstrike. This de-coupling of the lateral and medial side flexes improves the natural motion feel and flexibility of the sole 300.

Figure 5A:
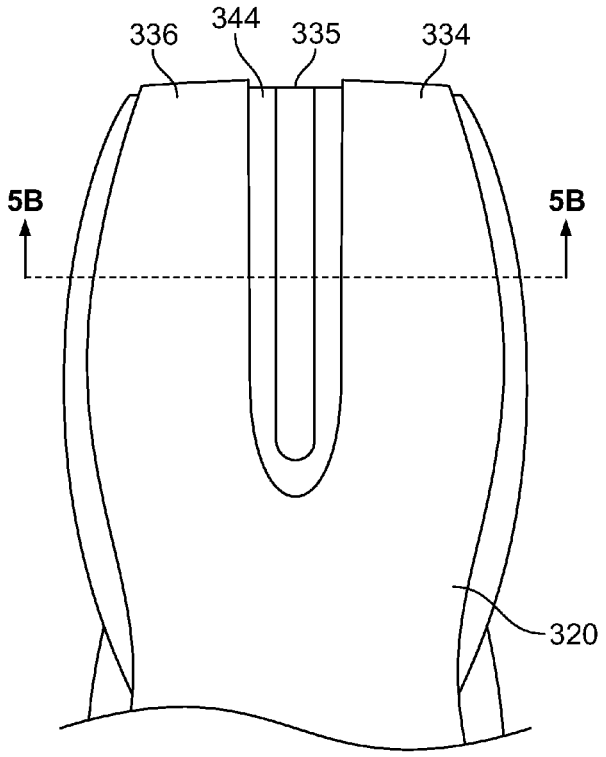
FIG. 5A is a fragmentary bottom view of a sole construction of FIG. 3.
Figure 5B:
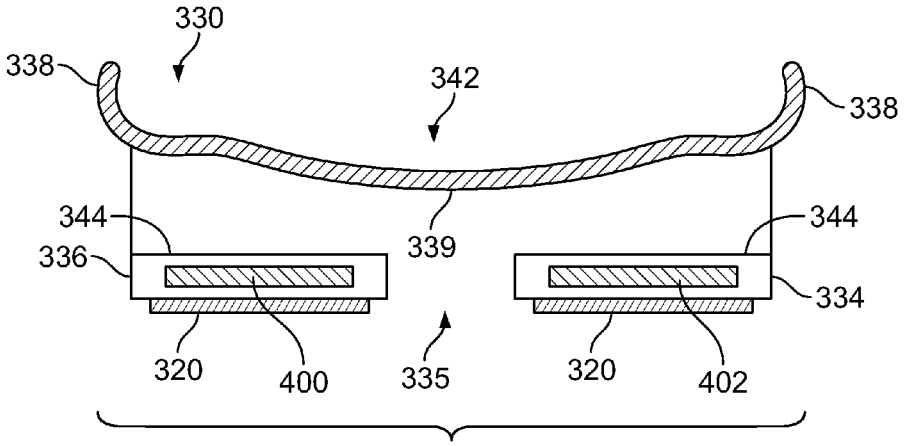
FIG. 5B is a partial sectional view of the sole construction taken along line 5B-5B shown in FIG. 5A.
Figure 6:
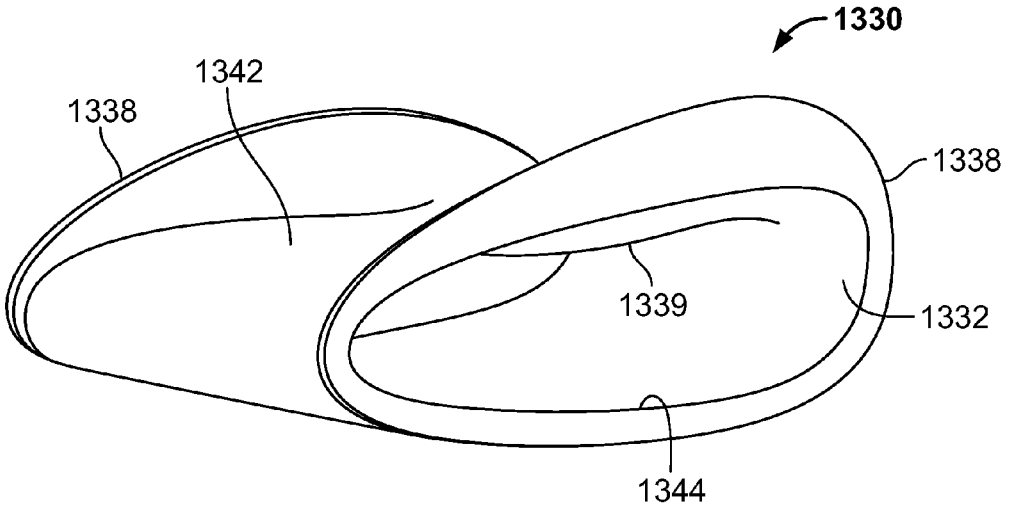
FIG. 6 is a perspective view of an alternative midsole structure shown in isolation.

In the example construction shown in FIGS. 5A and 5B, a composite matrix layer 400, 402 may be molded into the thickness of the surface 344 of the heel insert 330. In one construction, carbon fiber matrix fabric could be used in the heel insert 330. In this construction, the fiber matrix fabric acts similar to a stiffener. That is, the fiber matrix fabric has a greater modulus of elasticity than the surrounding material (e.g., plastic). In this way, a composite modulus (e.g., modulus of fabric and surrounding material) can be engineered to vary the stiffness in the heel insert 330. The thickness, width, and length of the fabric can be varied for a desired modulus. The matrix resin may be provided with approximately 10% to 25% fiber material to form a plastic resin composite. The plastic resin composite may be an enhanced resin having a filled fibrous composition, such as nylon, glass, or graphite fiber. The resin may be a polyester type. In one arrangement, the fibers can be oriented in a heel-to-toe direction to provide enhanced longitudinal tensile strength during forward propulsion of the foot of the wearer. The fibers combined with the heel-to-toe direction and oriented in the medial-to-lateral directions as well. The combined orientations enhance the shoe's ability to obviate over pronation of foot of the wearer and provide a stable platform for enhanced running.

In such a construction, composite matrix layer 400, 402 can be molded into or on heel insert 330. As utilized herein, the term "matrix" is intended to encompass a variety of configurations, including nets, grids, lattices, webs, fiber and perforated materials, for example, that form apertures. If desired, the layer 400, 402 may be formed as polymer matrix layer of unitary (i.e., one-piece) construction from polymer materials that include hard rubber, thermoplastic polyurethane, polypropylene, polyethylene, ethylvinylacetate, and styrene ethylbutylene styrene, resin for example. Although the hardness of the polymer material may vary within the scope of various aspects of footwear 100, a polymer material having a hardness of 98 or more on the Shore A scale or 75 or more on the Shore D scale (e.g., high-density polyethylene) may be used. In manufacturing footwear 100, layer 400, 402, the polymer material may be molded through an injection molding process to impart the unitary construction to heel insert 330. As an alternative construction, layer 400, 402 may be adhesively bonded to the surface 344 of heel insert 330 using composite lay-up techniques.

In one construction of the heel insert 330, raised flanges 338 are provided on the medial side and the lateral side. That is, the side edges 338 of the top wall of heel insert 330 wrap upward toward the ankle of the wearer. Among other benefits, this construction provides stiffness and lateral-medial or medial-lateral stability to the foot of the wearer during forward propulsion. Additionally, the construction helps prevent the heel insert 330 from excessive collapsing during compression when attenuating ground impact forces. This is due to the increase stiffness of the heel insert 330 provided by the flanges 338. These raised flanges 338 also may help better hold the wearer's heel on top of the sole 300

In one construction shown in FIG. 3, the midsole structure 321 includes material provided between the top surface of the heel insert 330 and the bottom of the upper 200 and the wearer's foot. This material may be a polymer foam midsole material, e.g., of the various types described above. This construction provides a comfortable fit and additional attenuation of the ground impact forces during propulsion.

As shown in FIG. 5B, in one construction of the heel insert 330, the top surface 342 includes a downward bulbous region or concave region 339 having a shallow radius R (see FIGS. 1-2) thereby forming a cup-like configuration to cradle the heel. This feature aids to direct the impact forces toward the center of the heel insert 330 to assist in more uniform distribution of the stress in the insert 330. Additionally, the concave region 339 assists in keeping the heel better fitted within the upper 200 and enhance stability of the footwear 100 on the wearer.

Figure 7:
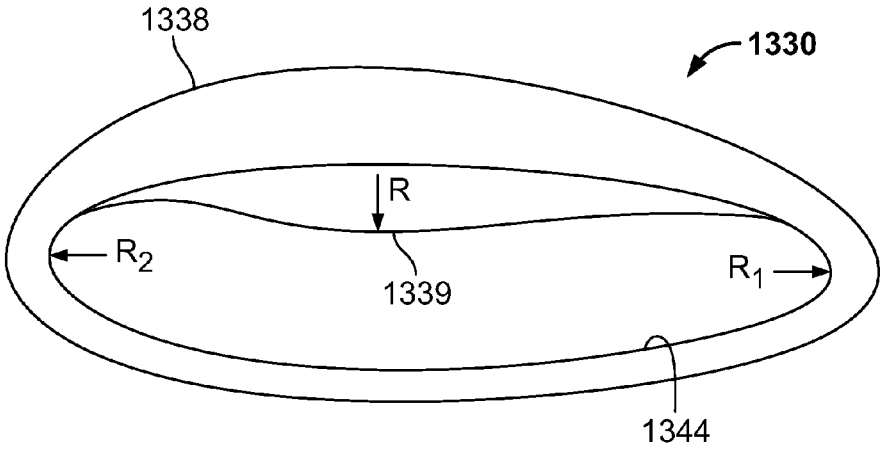
FIG. 7 is a lateral side view of the alternative midsole structure of FIG. 6.
Figure 8:
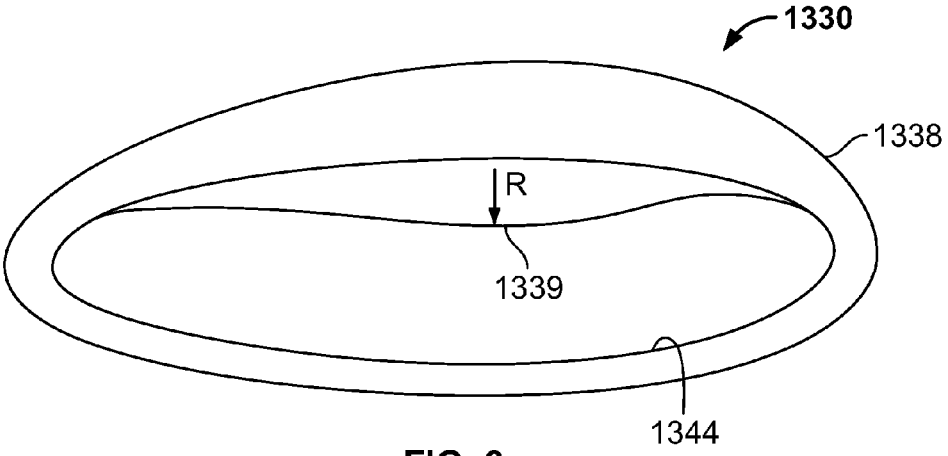
FIG. 8 is a medial side view of the alternative midsole structure of FIG. 6.
Figure 9:
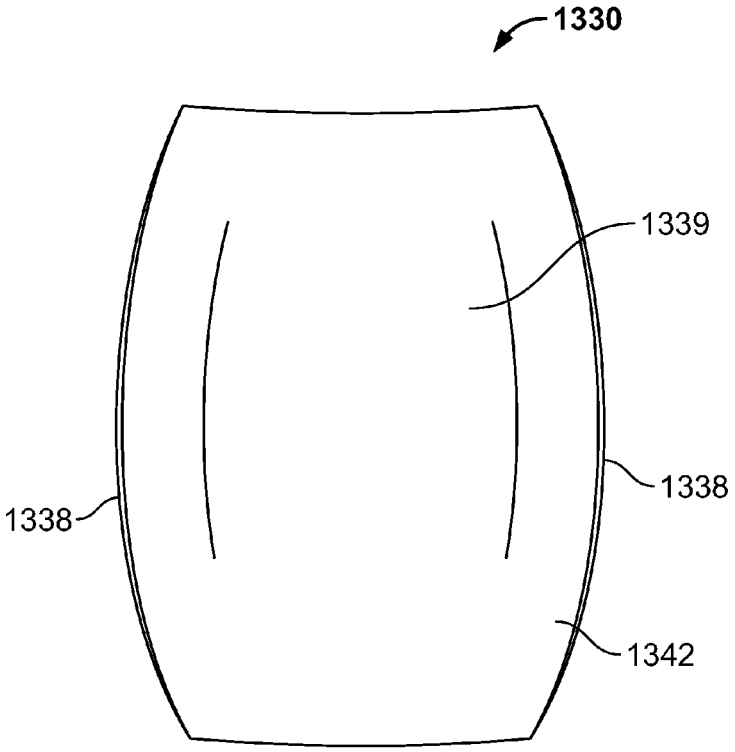
FIG. 9 is a top plan view of the alternative midsole structure of FIG. 6.
Figure 10:
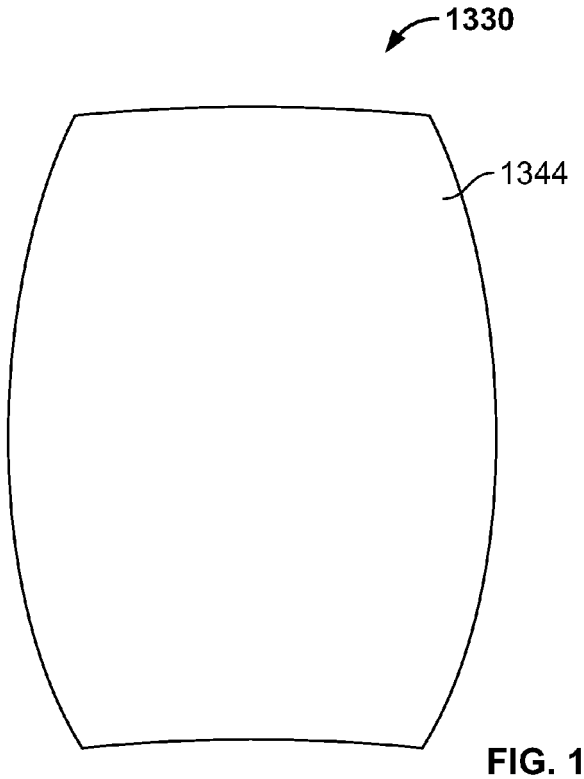
FIG. 10 is a bottom plan view of the alternative midsole structure of FIG. 6.
Figure 11:
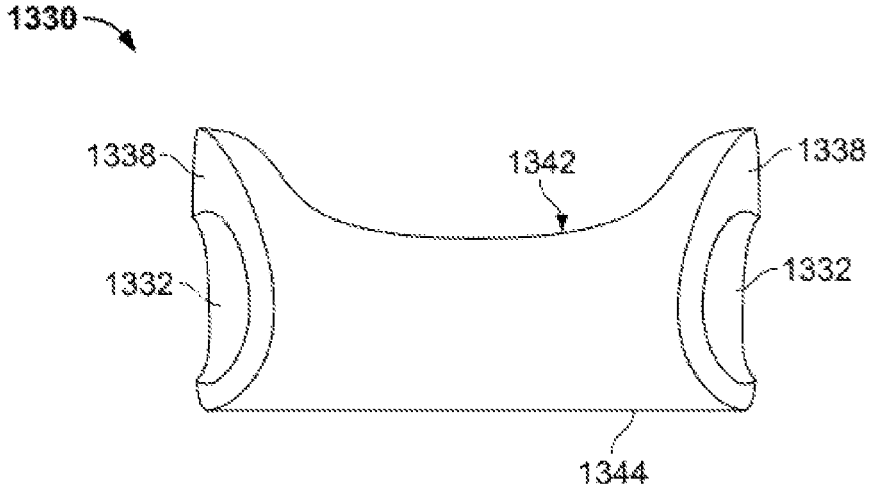
FIG. 11 is a front view of the alternative midsole structure of FIG. 6.

FIGS. 6-11 illustrate an alternative construction of the heel insert 1330 shown in isolation from the upper 200 and midsole 321. Heel insert 1330 is provided without a split or cut portion in the central area thereof. As shown in FIG. 7, the heel insert 1330 may be formed with an elliptical shape or a flatten elliptical shape (e.g., raindrop shaped structure in which rear curvature $R_2$ is greater than the front most curvature $R_1$) with an internal void/cavity 1332 therein to provide a region for flexing so that the insert 1330 attenuates the ground impact forces on foot strikes. The ratio of the $R_2/R_1$ in this example is greater than 1.0. Heel insert 1330 has a similar construction as heel insert 330 except that insert 1330 does not have a cutout portion. Heel insert 1330 has lower portion 1344 without a cutout or separation portion as was provided in heel insert 330. In construction of the heel insert 1330, the top surface 1342 includes a downward bulbous region or concave region 1339 having a shallow radius R thereby forming a cup-like configuration to cradle the heel which helps transmits the impact forces towards the center of the heel insert 1330 to assist in more uniform distribution of the compressive stresses in the insert 1330. Additionally, the concave region 1339 may provide an improved fit by retaining the heel within the upper 200 to enhance stability of the footwear 100 on the wearer. In one construction of the heel insert 1330, raised flanges 1338 are provided on the medial side and the lateral side.

Figure 12:
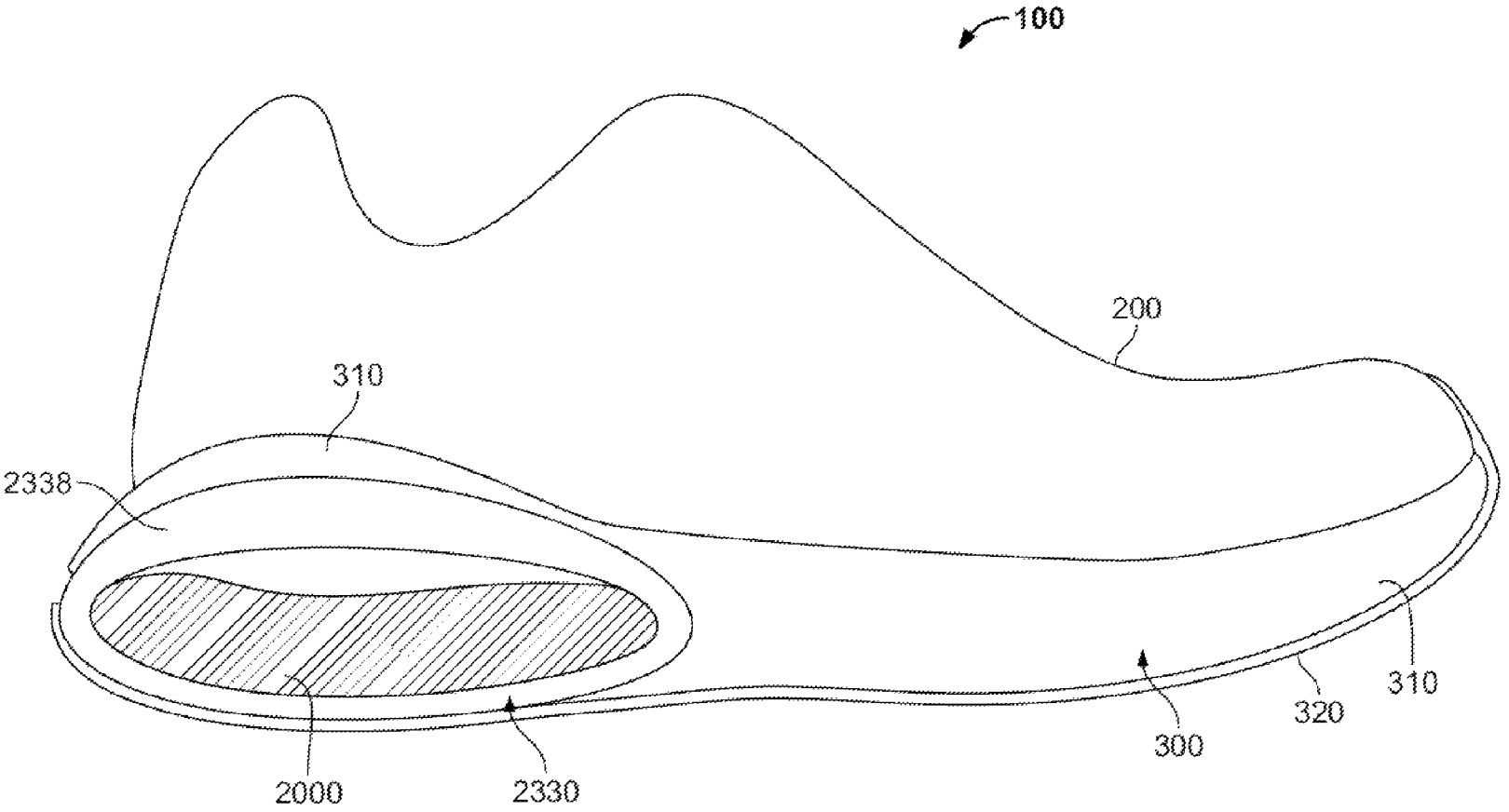
FIG. 12 is a lateral elevational view of an alternative article of footwear according to another example of this invention.

In one construction of footwear 100 shown in FIG. 12, the void area of heel insert 2330 may include a secondary impact force attenuation structure, 2000, such as a fluid-filled bladder, filled with air or other gas, to provide enhanced motion control and attenuation of ground forces. The secondary impact force attenuation structure 2000 may include a bladder type, foam type, column type or puck type impact force attenuation member. In one construction, the outsole 320 acts as a protective cover for the midsole 310 and may be adhesively bonded to the heel insert 2330 as shown in the figures. This type of secondary impact force attenuation member 2000 may be provided in sole structures with or without cutout 335. In one construction of the heel insert 2330, raised flanges 2338 are provided on the medial side and the lateral side.

Figure 13:
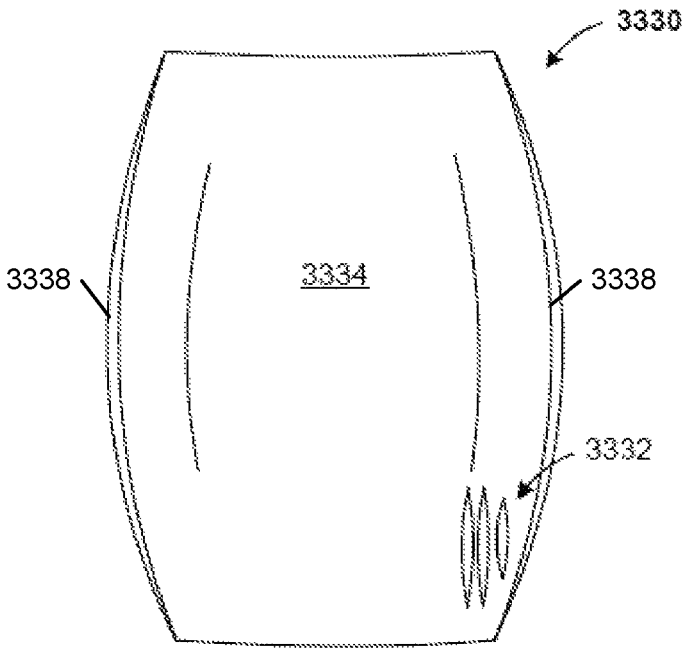
FIG. 13 is a top plan view of another alternative midsole structure shown in isolation.

Additional or alternative ways of controlling local flexibility of a heel insert may be provided without departing from this invention. FIG. 13 illustrates a top view of an alternative heel insert 3330 that may have a structure the same as or similar to those described above in conjunction with FIGS. 1-12 (e.g., without or without a cutout 335). In one construction of the heel insert 3330, raised flanges 3338 are provided on the medial side and the lateral side. This example heel insert 3330, however, further includes one or more grooves 3332 formed in its top surface 3334. Any number of grooves 3332 may be provided without departing from this invention. The grooves 3332 in this illustrated example are located at the rear lateral heel area of the heel insert 3330 to provide additional flexibility at the rear lateral heel corner of the sole structure. This feature may help provide a softer feel and/or more natural motion during a footstrike (in which the rear lateral portion of the wearer's heel hits the ground first).

The number, size, shape, depth, relative spacings, and/or relative orientations of the grooves 3332 may vary widely, e.g., depending on the desired change in local flexibility at the location of the groove(s) 3332. The groove(s) 3332 may extend completely or partially through the surface of the heel insert 3330 without departing from this invention. Additionally or alternatively, grooves 3332 of this type may be provided at other areas of the heel insert 3330 structure, e.g., at any location where increased local flexibility may be desired, including in the forward lateral area, the forward central area, the forward medial area, the central rear area, the center area, etc. Also, while not shown, groove(s) 3332 of this type may be provided on other surfaces of the heel insert 3330, such as on the outer bottom surface, the inner bottom surface (i.e., within the void), the inner top surface (i.e., within the void), etc.

Figure 14:
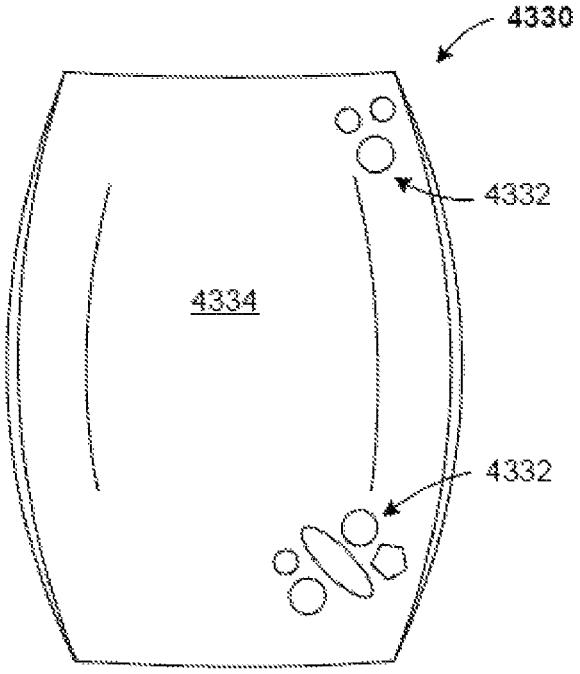
FIG. 14 is a top plan view of yet another alternative midsole structure shown in isolation.

As another example, FIG. 14 illustrates another example heel insert 4330 in which local flexibility is altered by recesses or through holes 4332 provided in a surface of the heel insert 4330. While the illustrated example shows the recesses or through holes 4332 provided in the top surface 4334 of the heel insert, additionally or alternatively, similar structures could be provided at other areas and/or on other surfaces of the heel insert 4330 without departing from this invention, e.g., as described above with respect to FIG. 13. Also, in the illustrated example of FIG. 14, recesses or through holes 4332 of various different shapes and/or sizes are provided in two areas of the heel insert 4330 (e.g., in the rear lateral heel and the forward lateral heel areas). One or more recesses or through holes 4332 may be provided in other areas of the heel insert structure 4330 in addition to and/or in place of the recesses or through holes 4332 shown in FIG. 14. When more than one recess or through hole 4332 is provided on a heel insert 4330 or in a specific area of the heel insert 4330, the recesses or through holes 4332 may have the same or different sizes and/or shapes without departing from this invention.

Grooves, recesses and/or through holes of the types described above in conjunction with FIGS. 13 and 14 may be directly formed in the heel insert structure, e.g., during the molding or other forming process for making the heel insert. Alternatively, if desired, the grooves, recesses and/or through holes may be provided after the heel insert is formed, e.g., using cutting, grinding, or drilling actions. Other ways of making the grooves, recesses and/or through holes may be used without departing from this invention. As another option, if desired, enhanced flexibility in localized areas may be provided by making the material of the heel insert somewhat thinner at the desired areas (e.g., by grinding or sanding, etc.).

As another option or alternative, rather than making a localized area more flexible (e.g., by providing grooves, recesses through holes, and/or thinned areas), localized areas of the heel insert may be made stiffer or less flexible, if desired. This may be accomplished, for example, by providing raised ribs or other structures on a heel insert surface, or by providing a thicker heel insert material thickness, at the desired localized areas of the heel insert. Such structural changes could be provided during production of the insert (e.g., during molding) or at a later time (e.g., by gluing one or more additional structures to a heel insert surface).

Localized flexibility changes (e.g., to create greater or less flexibility at a localized area) also may be accomplished for customization purposes. As some more specific examples, if desired, grooves, recesses, through holes, thinned surfaces, thicker surfaces, and/or additional structure(s) may be incorporated at various areas of a heel insert structure in response to feedback from a specific individual to make an area of the sole "harder" or "softer." In this manner, an individual user may be able to obtain a sole structure having a "customized" feel.

In operation, the previously described features, individually and/or in any combination, improve stability and traction control. Further, the features of the footwear 100 reduce injury. In one construction, these advantages are also achieved by the differentiation of design in the medial 336 and lateral 334 region of footwear 100 and the synergistic effects of the two regions. While the various features of footwear 100 work together to achieve the advantages previously described, it is recognized that individual features and sub-combinations of these features can be used to obtain some of the aforementioned advantages without the necessity to adopt all of these features shown FIGS. 1-14.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear having an upper and a sole structure secured to the upper, the sole structure comprising:
- an outsole;
- a midsole connected to the outsole and disposed between the outsole and the upper;
- a heel midsole impact force attenuating structure arranged at least within a heel region of the midsole, wherein the heel midsole impact force attenuating structure includes a molded heel region member extending from a lateral side of the article of footwear to a medial side of the article of footwear, wherein the heel region member consists essentially of:
  - (a) a hollow central region,
  - (b) a top surface above the hollow central region,
  - (c) a lower surface below the hollow central region, and
  - (d) a plurality of grooves defined in the top surface of the heel region member only at a rear lateral heel area of the heel region member, wherein the plurality of grooves are in one quadrant of the heel region member, and wherein the plurality of grooves extend partially or completely through the top surface of the heel region member and increase flexibility of the rear lateral heel area of the heel region member.

2. The article of footwear of claim 1, wherein the plurality of grooves extend partially through the top surface of the heel region member.

3. The article of footwear of claim 1, wherein the plurality of grooves extend completely through the top surface of the heel region member.

4. The article of footwear of claim 1, wherein the hollow central region has an elliptically shaped opening at a lateral side of the heel region member and an elliptically shaped opening at a medial side of the heel region member.

5. The article of footwear of claim 1, wherein the heel region member is formed of a member selected from the group consisting of: nylon, a polyether block amide (PEBA), and a carbon fiber reinforced polymer.

6. The article of footwear of claim 1, wherein the lower surface of the heel region member has a medial portion and a lateral portion divided by a separation region.

7. An article of footwear having an upper and a sole structure secured to the upper, the sole structure comprising:
- an outsole;
- a midsole connected to the outsole and disposed between the outsole and the upper;
- a heel midsole impact force attenuating structure arranged at least within a heel region of the midsole, wherein the heel midsole impact force attenuating structure includes a molded heel region member extending from a lateral side of the article of footwear to a medial side of the article of footwear, wherein the heel region member consists essentially of:
  - (a) a hollow central region,
  - (b) a top surface above the hollow central region,
  - (c) a lower surface below the hollow central region,
  - (d) a plurality of grooves defined in the top surface of the heel region member only at a rear lateral heel area of the heel region member, wherein the plurality of grooves are in one quadrant of the heel region member, and wherein the plurality of grooves extend partially or completely through the top surface of the heel region member and increase flexibility of the rear lateral heel area of the heel region member,
  - (e) a lateral side flange extending upward from the top surface at a lateral side of the heel region member, and
  - (f) a medial side flange extending upward from the top surface at a medial side of the heel region member, wherein the top surface extends between the lateral side flange and the medial side flange.

8. The article of footwear of claim 7, wherein the plurality of grooves extend partially through the top surface of the heel region member.

9. The article of footwear of claim 7, wherein the plurality of grooves extend completely through the top surface of the heel region member.

10. The article of footwear of claim 7, wherein the hollow central region has an elliptically shaped opening at a lateral side of the heel region member and an elliptically shaped opening at a medial side of the heel region member.

11. The article of footwear of claim 7, wherein the heel region member is formed of a member selected from the group consisting of: nylon, a polyether block amide (PEBA), and a carbon fiber reinforced polymer.

12. The article of footwear of claim 7, wherein the lower surface of the heel region member has a medial portion and a lateral portion divided by a separation region.

13. An article of footwear having an upper and a sole structure secured to the upper, the sole structure comprising:
- an outsole;
- a midsole connected to the outsole and disposed between the outsole and the upper;
- a heel midsole impact force attenuating structure arranged at least within a heel region of the midsole, wherein the heel midsole impact force attenuating structure includes a molded heel region member extending from a lateral side of the article of footwear to a medial side of the article of footwear, wherein the heel region member consists essentially of:
  - (a) a hollow central region,
  - (b) a top surface above the hollow central region,
  - (c) a lower surface below the hollow central region, and
  - (d) a plurality of grooves, recesses, or through holes defined in the top surface of the heel region member only at a rear lateral heel area of the heel region member, wherein the plurality of grooves, recesses, or through holes are in one quadrant of the heel region member, and wherein the plurality of grooves, recesses, or through holes increase flexibility of the rear lateral heel area of the heel region member.

14. The article of footwear of claim 13, wherein the hollow central region has an elliptically shaped opening at a lateral side of the heel region member and an elliptically shaped opening at a medial side of the heel region member.

15. The article of footwear of claim 13, wherein the heel region member is formed of a member selected from the group consisting of: nylon, a polyether block amide (PEBA), and a carbon fiber reinforced polymer.

16. The article of footwear of claim 13, wherein the lower surface of the heel region member includes a medial portion and a lateral portion divided by a separation region.

* * * * *